United States Patent [19]

Tosserams

[11] Patent Number: 4,993,701

[45] Date of Patent: Feb. 19, 1991

[54] RECEIVING TRAY FOR SHEET FORM MATERIAL

[75] Inventor: Willem A. Tosserams, Reuver, Netherlands

[73] Assignee: Oce-Nederland B.V., Venlo, Netherlands

[21] Appl. No.: 367,974

[22] Filed: Jun. 19, 1989

[30] Foreign Application Priority Data

Jun. 24, 1988 [NL] Netherlands ..... 8801610

[51] Int. Cl.[5] ..... B65H 31/20

[52] U.S. Cl. ..... 271/207

[58] Field of Search ..... 271/207, 213, 223, 224, 271/187, 186

[56] References Cited

FOREIGN PATENT DOCUMENTS

| | | | |
|---|---|---|---|
| 17452 | 1/1984 | Japan | 271/213 |
| 17766 | 1/1988 | Japan | 271/207 |
| 2176770 | 1/1987 | United Kingdom . | |

*Primary Examiner*—Richard A. Schacher

*Attorney, Agent, or Firm*—Reed, Smith, Shaw & McClay

[57] ABSTRACT

A receiving tray for material in sheet form coming from a copying machine which includes a support that is rotatable about a pivot axis and which can be set to two positions by hand. The first position is for receiving loose sheets on a first support surface of the support and the second position is for receiving computer forms on a second support surface of the support oppositely disposed from the first support surface. The support is provided with a sheet stop and a guide element pivotally connected to the sheet stop. In the first position the support directly adjoins a sheet exit of the copying machine and the guide element is disposed beneath the support. In the second position the guide element forms a sheet guide between the sheet exit of the copying machine and the receiving tray for the deposition of a computer form in the receiving tray which in this position has a greater storage capacity than in the first position.

5 Claims, 2 Drawing Sheets

RECEIVING TRAY FOR SHEET FORM MATERIAL

FIELD OF THE INVENTION

The invention relates to a receiving tray for material in sheet form, more particularly material coming from a copying machine.

BACKGROUND OF THE INVENTION

Receiving trays for copying machines for receiving stacks of copied fan folded originals are known, e.g., U.S. Pat. No. 4,635,916 and U.K. Patent Application G.B. 2 176 770 A. In U.S Pat. No. 4,191,467 a copying machine is provided with a rotatable receiving tray which can receive in one position an original zig-zag folded long form having fold lines (hereinafter referred to as "computer forms") while in its other position it can receive only loose copy sheets. In the first position the receiving tray clears the exit where copy sheets are discharged from the copying machine to guide long copy sheets having fold lines into a receiving tray for zig-zag folded copy sheets. This tray is being situated beneath the rotatable receiving tray. In the other position, the rotatable receiving tray can receive copy sheets but cannot receive originals.

It is an object of this invention to provide a receiving tray for use in a copying machine, which tray in the first position, can receive a small stack of loose originals and, in the second position, a large stack of zig-zag folded originals.

SUMMARY OF THE INVENTION

Generally, the present invention provides a rotatable receiving tray having a pivot axis and oppositely situated support surfaces in which the distances between the support surfaces and the pivot axis are different. Consequently, the effective support surface of the receiving tray in the first position is at a higher level than in the second position. Thus, in the first position loose originals can be satisfactorily deposited while in the second position a long original having fold lines can be deposited in zig-zag folded form.

In one embodiment of the invention, the distance between the pivot axis and one edge of a receiving tray support surface is less than the distance between the pivot axis and the opposite edge of the same support surface. Consequently, in the first position the support surface operative in that position can directly adjoin the exit point where originals are discharged from the copying machine. In this embodiment, loose originals can be fed directly from the exit place to the operative support surface. In the second position, the support surface operative in that position is situated at a distance from the exit place so that a long original having fold lines and discharged from the copying machine at the same exit place can be folded in zig-zag fashion along the fold lines in the area between the exit and the support surface operative in the second position.

In another embodiment of the invention, the receiving tray support, at the support surface edge closest to the pivot axis is provided with a sheet stop. Consequently, in the second position of the support the sheet stop can extend in an area occupied by the support when the latter is in the first position, so that the capacity of the receiving tray can be large in the second position in comparison with the capacity of the receiving tray in the first position.

In a further embodiment, the receiving tray includes a bent guide element which is connected by a hinge to the end of the sheet stop situated opposite the edge of the sheet stop connected to the support. The guide element can rotate about the hinge from a first position in which the guide element is situated in the space defined by the sheet stop and the adjoining support surface to a second position in which the guide element is flush with the sheet stop. Consequently, the receiving tray is compact in the first position, while in the second position it forms a good guide for zigzag folding of an original having fold lines. By providing the guide element with a plate having a profiled edge which can rest on a rod and which ensures that, on rotation of the support from the first position to the second position, the guide element moves substantially parallel to itself from the position in which it is situated beneath the support surfaces to the second position, the receiving tray can be moved from the first position to the second position and vice versa by simple manual movement. Other advantages of the invention will become apparent from a perusal of the following detailed description of presently preferred embodiments of the invention taken in connection with the accompanying drawings.

PRESENTLY PREFERRED EMBODIMENT

Figure 1:
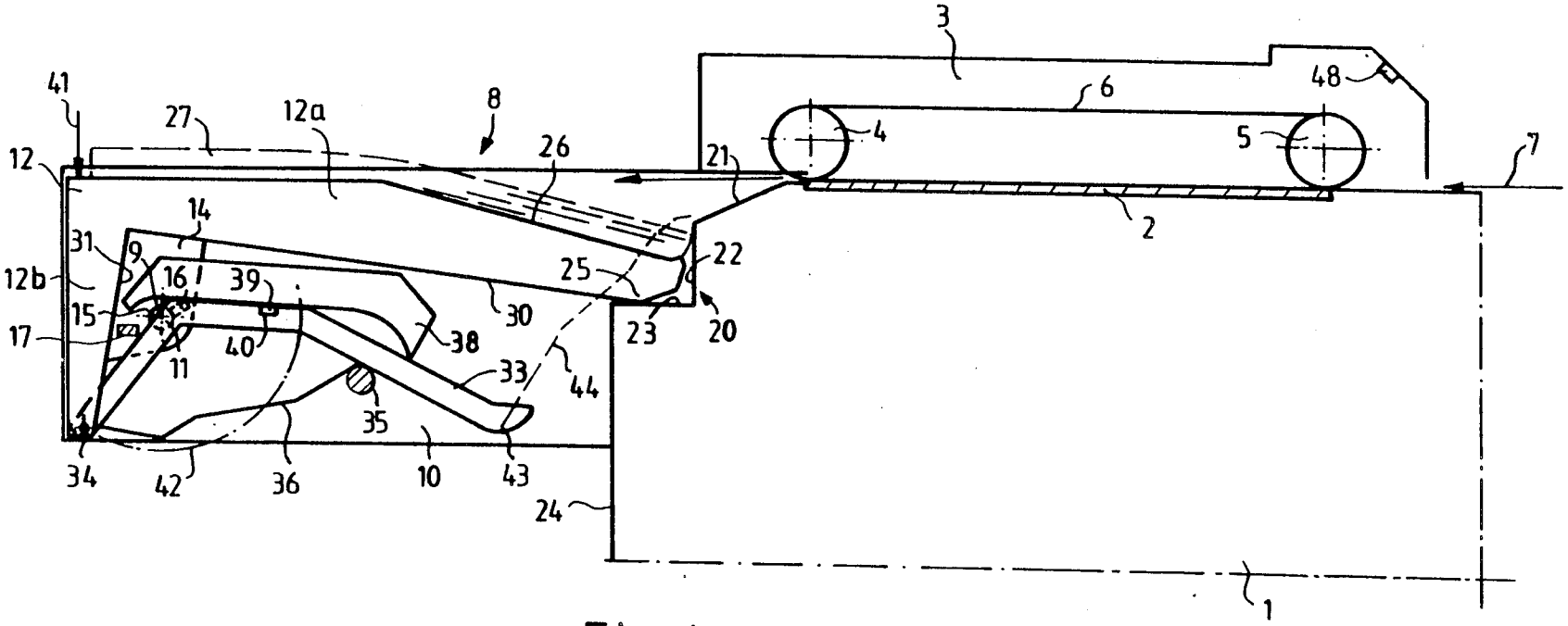
FIG. 1 is a section of part of a copying machine provided with a receiving tray according to the invention in a position for receiving loose originals.

The copying machine 1 represented in the drawings has at its top an exposure window 2 on which an original for copying can be placed. The exposure window 2 is covered by a hinged cover 3. A conveyor belt 6 trained about rollers 4 and 5 is contained in cover 3. Conveyor belt 6 rests on the exposure window 2 for conveying an original from feed point 7 to an exposure position on exposure window 2 and for conveying the original from the exposure position to a receiving tray 8 situated opposite feed point 7 after exposure.

Receiving tray 8 is rotatably fixed about pivot 9 between two frame plates 10 which project from the copying part of copying machine 1. Receiving tray 8 comprises an L-shaped body 12 with a long leg **12*a* and a short leg 12*b*. Long leg 12*a* forms the carrier for originals to be collected and short leg 12*b* forms a sheet stop. Brackets 14 are disposed in the angle between legs 12*a* and 12*b*. Legs 12*a* and 12*b* are secured by pins 15 to brackets 14. The axis of pins 15 coincide with pivot axis 9. Pins 15 fit rotatably in holes 11 formed in frame plates 10 near the edge remote from the copying part. A projection 16 is secured to each pin 15 which preferably cooperates with lug 17 on frame plate 10 to limit the rotation of the receiving tray 8** in one direction.

An abutment 20 is disposed on the copying machine and consists of three parts. A first part 21 extends slantingly downwards from the exposure window 2 for some distance. A second part 22 extends straight down from part 21 and a third part 23 which extends substantially perpendicularly from second part 22 to the side wall 24 of the copying part of the copying machine.

In the position of the receiving tray 8 represented in FIG. 1, carrier 12*a* is situated above pivot 9 and the receiving tray rests by an end 25 of the carrier 12*a* on part 23 of abutment 20. That side of the L-shaped body 12 which faces pivot 9 is formed by support surface 30 on long leg 12*a* and abutment surface 31 on short leg 12*b*. Abutment surface 31 forms an angle of about 90° with support surface 30. Support surface 26 is situated opposite support surface 30 on long leg 12*a*.

A bent guide element 33 is connected at one end by hinge 34 to the end of the short leg 12*b*. In the position of the receiving tray represented in FIG. 1, guide element 33 rests on rod 35 secured between frame plates 10. Guide element 33 has a profiled plate 36 at the underside which upon rotation of the receiving tray from the position represented in FIG. 1 cooperates with rod 35 explained hereinafter. In the space which is present between guide element 33 and the L-shaped body 12 in the position represented in FIG. 1, there is disposed an auxiliary member 38 which is used when processing computer forms. To this end, auxiliary member 38 is provided with a pin 39 which fits in a hole 40 in guide element 33 for detachably securing the auxiliary member 38 on guide element 33.

Figure 2:
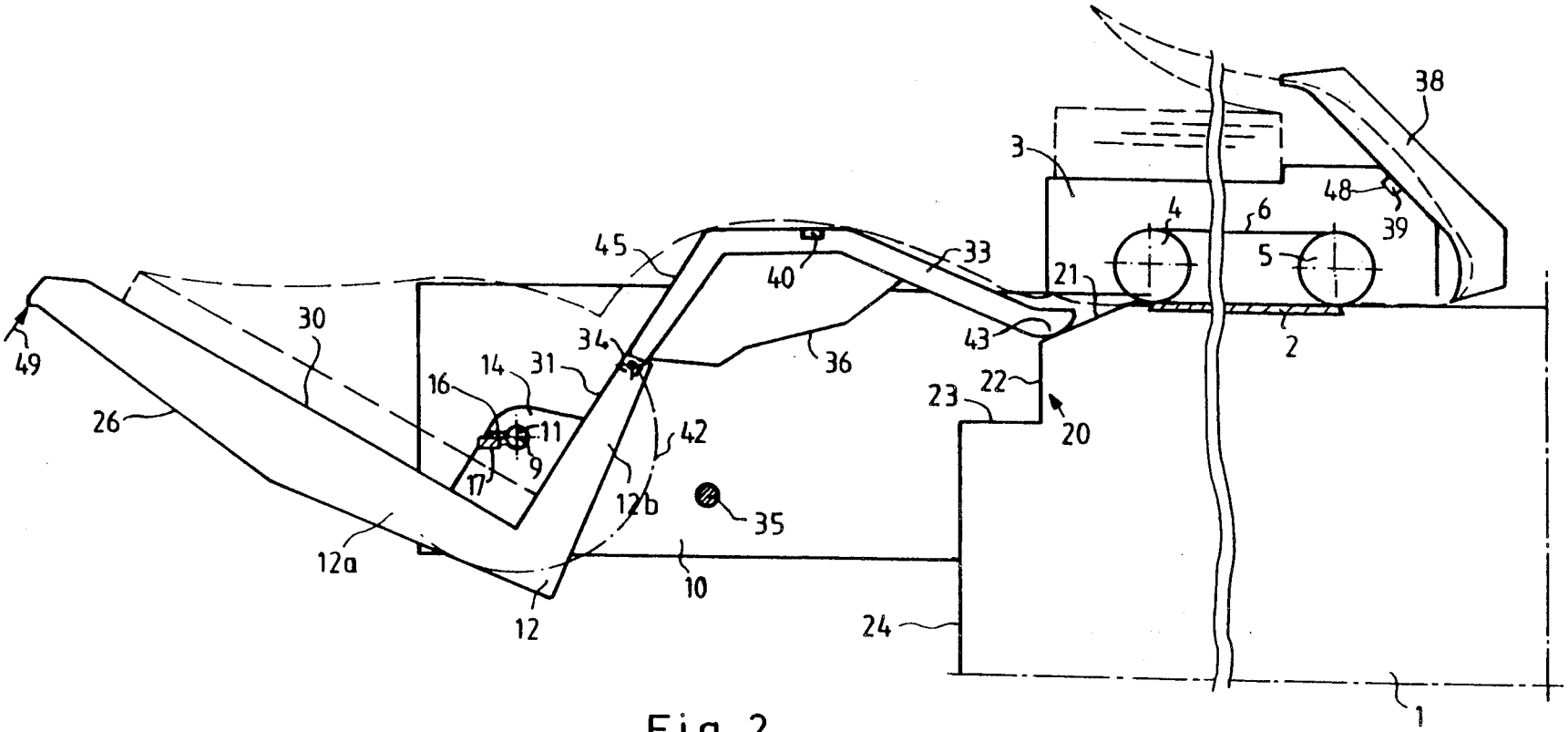
FIG. 2 is the same section as in FIG. 1, but with the copying machine in a position for processing computer form originals.

Starting from the position of the copying machine represented in FIG. 1, the copying machine is arranged as follows for processing computer forms: by pressing on the receiving tray at place indicated by arrow 41, body 12 rotates about pivot 9. In this case hinge 34 describes a circular path indicated by reference 42. In the first part of this movement the profiled plate 36 slides over rod 35, the end 43 of guide element 33 describing a path denoted by line 44 with end 43 coming to rest on abutment part 21. In the second part of the movement of hinge 34 in the circular path 42, profiled plate 36 is free of rod 35 and guide element 33 rotates about end 43 resting on abutment part 21. In the end position represented in FIG. 2, in which abutment surface 31 and the adjoining surface 45 of guide element 33 are in the same plane projection 16 strikes against the lug 17. Since the center of gravity of the rotatable part of the receiving tray in the position represented in FIG. 2 lies on that side of pivot 9 which is remote from guide element 33 this end position is a stable state. Auxiliary member 38 can now be removed from guide element 33 and placed on cover 3, by means of lug 39 and an aperture 48 provided for the same in the cover 3, to form an inlet guide for computer forms. In this state, the computer form folded zig-zag can be placed on cover 3, such that the front edge of the computer form is placed over the inlet guide 38 and pushed between exposure window 2 and conveyor belt 6. When the copying machine is then put into operation, conveyor belt 6 feeds the computer form from the stock over the exposure window 2. The computer form then moves over guide element 33 into receiving tray 8 with the leading edge of the computer form arriving at the angle between the support surface 30 and the abutment surface 31 and the computer form then being placed in the receiving tray in zig-zag folded form.

It has been found that for good deposition of computer forms of conventional type e.g. 60 g paper and a size of 380×279.5 mm, the front edge and the following even folding edges must be able to move freely downwards over a distance of 65 mm minimum along the side abutment formed by surfaces 31 and 45. To receive a stack of computer forms comprising 1000 sheets with a height of about 100 mm including the distance that the fold lines may creep up along the abutment, the receiving tray should have a depth of 165 mm. By ensuring that the hinge point 34 is approximatelY half way along the tray depth, in the position represented in FIG. 2, good deposition is obtained with a small overall height for the receiving tray.

Once the set of computer forms has been removed from the receiving tray, the latter can readily be reset to the original position, by first placing the inlet guide 38 on the sheet guide 33 and then pressing on the receiving tray at the place denoted by arrow 49 until the position represented in FIG. 1 again is obtained.

While presently preferred embodiments of the invention have been shown and described in particularity, the invention may be otherwise embodied within the scope of the appended claims.

What is claimed is:

1. A receiving tray for material in sheet form, comprising a support rotatable about a pivot axis and having two support surfaces on opposing sides of said support facing away from each other, each of said support surfaces being spaced apart from said pivot axis at a different distance, said support being operable in each of two positions, a first position in which one of the support surfaces can receive material in sheet form, and a second position in which the other support surface can receive material in sheet form.

2. A receiving tray according to claim 1, wherein the distance between said pivot axis and one edge of a support surface is less than the distance between the pivot axis and the opposite edge of said same support surface.

3. A receiving tray according to claim 2, wherein said support is provided with a sheet stop at the support surface edge closest to the pivot axis.

4. A receiving tray according to claim 3, including a bent guide element connected by a hinge to the end of said sheet stop disposed opposite the edge of said sheet stop connected to said support, said guide element being rotatable about said hinge from a first position in which said guide element is situated in the space at the side of the sheet stop facing towards the support and to a second position in which said guide element is situated in the space at the opposite side of said sheet stop facing away from the support and in which its guide surface is flush with said sheet stop.

5. A receiving tray according to claim 4, wherein said guide element includes a plate having a profiled edge which can bear on a rod to ensure that on rotation of said support from its first position to its second position that guide element is moved substantially parallel to itself from its first position in which it is situated beneath said support surfaces into its second position.

* * * * *